US011118605B1

(12) United States Patent
Reiners et al.

(10) Patent No.: US 11,118,605 B1
(45) Date of Patent: Sep. 14, 2021

(54) ACCUMULATOR PRE-CHARGE DETERMINATION

(71) Applicant: DEERE & COMPANY, Moline, IL (US)

(72) Inventors: Alexander Reiners, Thibodaux, LA (US); John A. Dighton, Thibodaux, LA (US); Peter A. Johnson, Thibodaux, LA (US)

(73) Assignee: DEERE & COMPANY, Moline, IL (US)

( * ) Notice: Subject to any disclaimer, the term of this patent is extended or adjusted under 35 U.S.C. 154(b) by 0 days.

(21) Appl. No.: 17/145,606

(22) Filed: Jan. 11, 2021

(51) Int. Cl.

| | |
|---|---|
| ***F15B 1/033*** | (2006.01) |
| ***F15B 19/00*** | (2006.01) |
| ***F15B 1/02*** | (2006.01) |
| ***E02F 9/22*** | (2006.01) |

(52) U.S. Cl.
CPC ..... *F15B 1/033* (2013.01); *E02F 9/2221* (2013.01); *F15B 1/024* (2013.01); *F15B 19/005* (2013.01); *F15B 2201/50* (2013.01); *F15B 2211/625* (2013.01)

(58) Field of Classification Search
CPC ..... F15B 1/033; F15B 19/005; F15B 2201/50
See application file for complete search history.

(56) References Cited

U.S. PATENT DOCUMENTS 3,494,192 A * 2/1970 Zahid ..... G01F 23/14 73/290 R
4,781,061 A * 11/1988 Baumgartl ..... F15B 1/08 73/149
7,552,577 B2 * 6/2009 Strasser ..... A01D 41/141 56/10.2 R
8,532,892 B2 * 9/2013 Nassouri ..... F16H 61/0025 701/60
8,833,143 B2 * 9/2014 Chen ..... F15B 19/005 73/37
9,358,966 B2 * 6/2016 Thompson ..... B60T 13/14
9,879,404 B2 * 1/2018 Schroeder ..... F15B 21/14
10,174,770 B2 * 1/2019 Zhang ..... F15B 11/024
2014/0060030 A1 3/2014 Ma et al.
2019/0234514 A1 * 8/2019 Weinhardt ..... F15B 1/033
2021/0131452 A1 * 5/2021 Takahashi ..... E02F 9/267

FOREIGN PATENT DOCUMENTS

DE 102005052640 B3 2/2007

OTHER PUBLICATIONS

Chapter 16: Accumulators, Hydro-Pneumatic Accumulators, https://www.hydraulicspneumatics.com/technologies/other-technologies/article/21884186/chapter-16-accumulators, Bud Trinkel, May 19, 2007, 12 pages.

* cited by examiner

*Primary Examiner* — Michael Leslie
(74) *Attorney, Agent, or Firm* — Taft Stettinius & Hollister LLP; Stephen F. Rost

(57) ABSTRACT

An exemplary method generally includes charging hydraulic fluid into or out of a cavity of an accumulator at a controlled flowrate, detecting movement of a machine component from a first position toward a second position, determining an idle time spanning from a start of the charging to detection of the movement of the machine component, and determining a pre-charge of the accumulator based upon the idle time and a flowrate value of the controlled flowrate.

20 Claims, 5 Drawing Sheets

ACCUMULATOR PRE-CHARGE DETERMINATION

TECHNICAL FIELD

The present disclosure generally relates to hydraulic systems, and more particularly but not exclusively relates to hydraulic systems for work machines.

BACKGROUND

Accumulators are often provided in hydraulic circuits to provide pressure to the hydraulic fluid. One characteristic of an accumulator is its pre-charge, which corresponds to the pressure in a cavity of the accumulator. The level of pre-charge can be correlated with the health of the accumulator in that the pre-charge will begin to fall as the accumulator begins to fail or is in need of maintenance. Conventional methods of detecting the pre-charge suffer from certain limitations, such as those related to reliability and repeatability. For these reasons among others, there remains a need for further improvements in this technological field.

SUMMARY

An exemplary method generally includes charging hydraulic fluid into or out of a cavity of an accumulator at a controlled flowrate, detecting movement of a machine component from a first position toward a second position, determining an idle time spanning from a start of the charging to detection of the movement of the machine component, and determining a pre-charge of the accumulator based upon the idle time and a flowrate value of the controlled flowrate. Further embodiments, forms, features, and aspects of the present application shall become apparent from the description and figures provided herewith.

DETAILED DESCRIPTION OF ILLUSTRATIVE EMBODIMENTS

Figure 1:
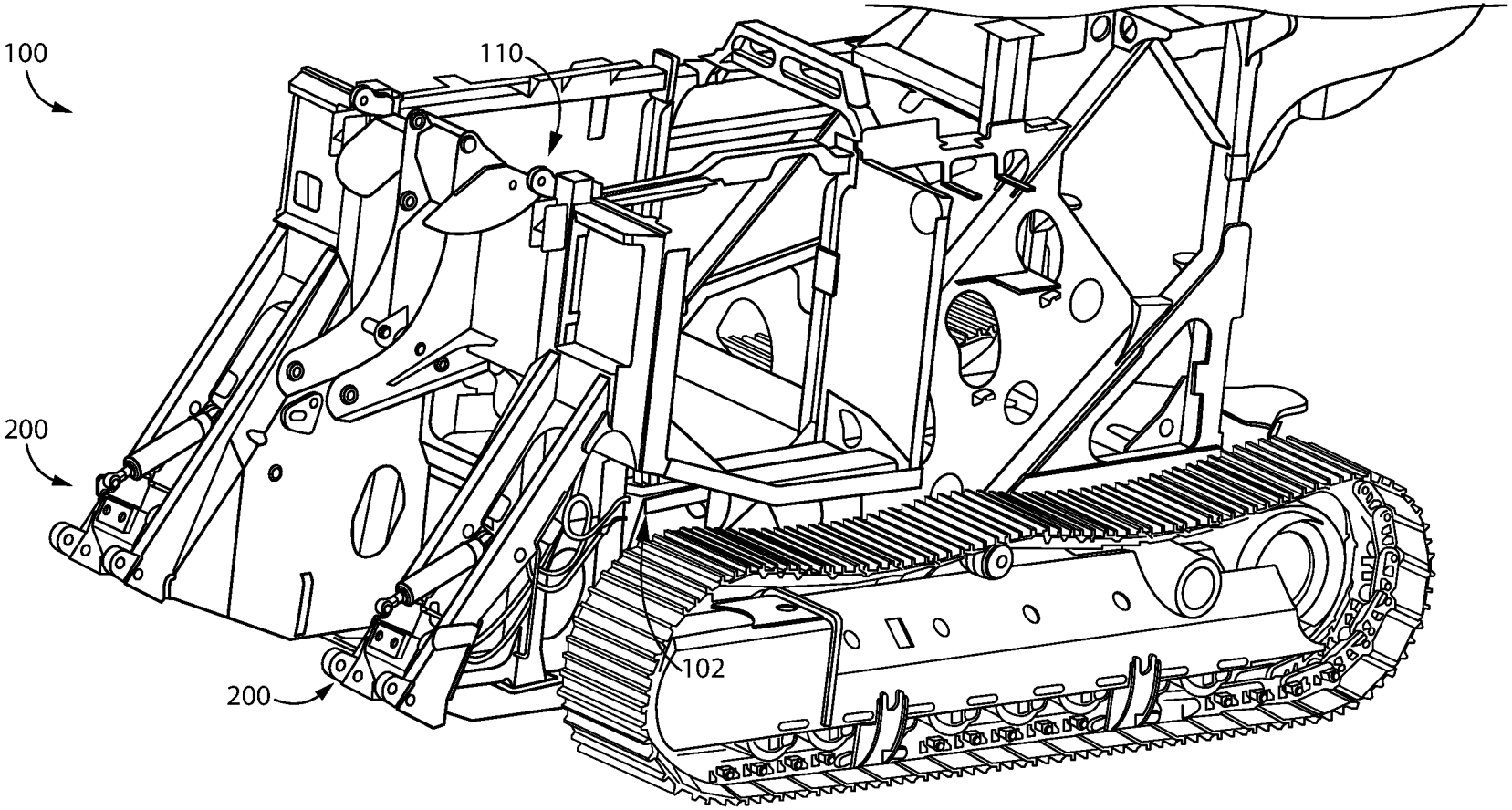
FIG. 1 is a perspective illustration of a work machine according to certain embodiments.

Although the concepts of the present disclosure are susceptible to various modifications and alternative forms, specific embodiments have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. It should further be appreciated that although reference to a "preferred" component or feature may indicate the desirability of a particular component or feature with respect to an embodiment, the disclosure is not so limiting with respect to other embodiments, which may omit such a component or feature. Further, when a particular feature, structure, or characteristic is described in connection with an embodiment, it is submitted that it is within the knowledge of one skilled in the art to implement such feature, structure, or characteristic in connection with other embodiments whether or not explicitly described.

Additionally, it should be appreciated that items included in a list in the form of "at least one of A, B, and C" can mean (A); (B); (C); (A and B); (B and C); (A and C); or (A, B, and C). Similarly, items listed in the form of "at least one of A, B, or C" can mean (A); (B); (C); (A and B); (B and C); (A and C); or (A, B, and C). Items listed in the form of "A, B, and/or C" can also mean (A); (B); (C); (A and B); (B and C); (A and C); or (A, B, and C). Further, with respect to the claims, the use of words and phrases such as "a," "an," "at least one," and/or "at least one portion" should not be interpreted so as to be limiting to only one such element unless specifically stated to the contrary, and the use of phrases such as "at least a portion" and/or "a portion" should be interpreted as encompassing both embodiments including only a portion of such element and embodiments including the entirety of such element unless specifically stated to the contrary.

In the drawings, some structural or method features may be shown in certain specific arrangements and/or orderings. However, it should be appreciated that such specific arrangements and/or orderings may not necessarily be required. Rather, in some embodiments, such features may be arranged in a different manner and/or order than shown in the illustrative figures unless indicated to the contrary. Additionally, the inclusion of a structural or method feature in a particular figure is not meant to imply that such feature is required in all embodiments and, in some embodiments, may be omitted or may be combined with other features.

The disclosed embodiments may, in some cases, be implemented in hardware, firmware, software, or a combination thereof. The disclosed embodiments may also be implemented as instructions carried by or stored on one or more transitory or non-transitory machine-readable (e.g., computer-readable) storage media, which may be read and executed by one or more processors. A machine-readable storage medium may be embodied as any storage device, mechanism, or other physical structure for storing or transmitting information in a form readable by a machine (e.g., a volatile or non-volatile memory, a media disc, or other media device).

With reference to FIG. 1, illustrated therein is a work machine 100 according to certain embodiments. The work machine 100 generally includes a machine component 110 and a hydraulic system 200 according to certain embodiments, which is operable to move the machine component 110 between a first position and a second position. In the illustrated form, the first position and the second position are vertically offset from one another such that the hydraulic system 200 raises and lowers the machine component 110 during movement of the component 110 between its first position and its second position. The work machine 100 may further include one or more stops 102 that support the component 110 when the component 110 is in its lower position. In the illustrated form, the work machine 100 is provided as mobile agricultural equipment. It is also contemplated that the work machine 100 may take another form, which may not necessarily be mobile.

Figure 2:
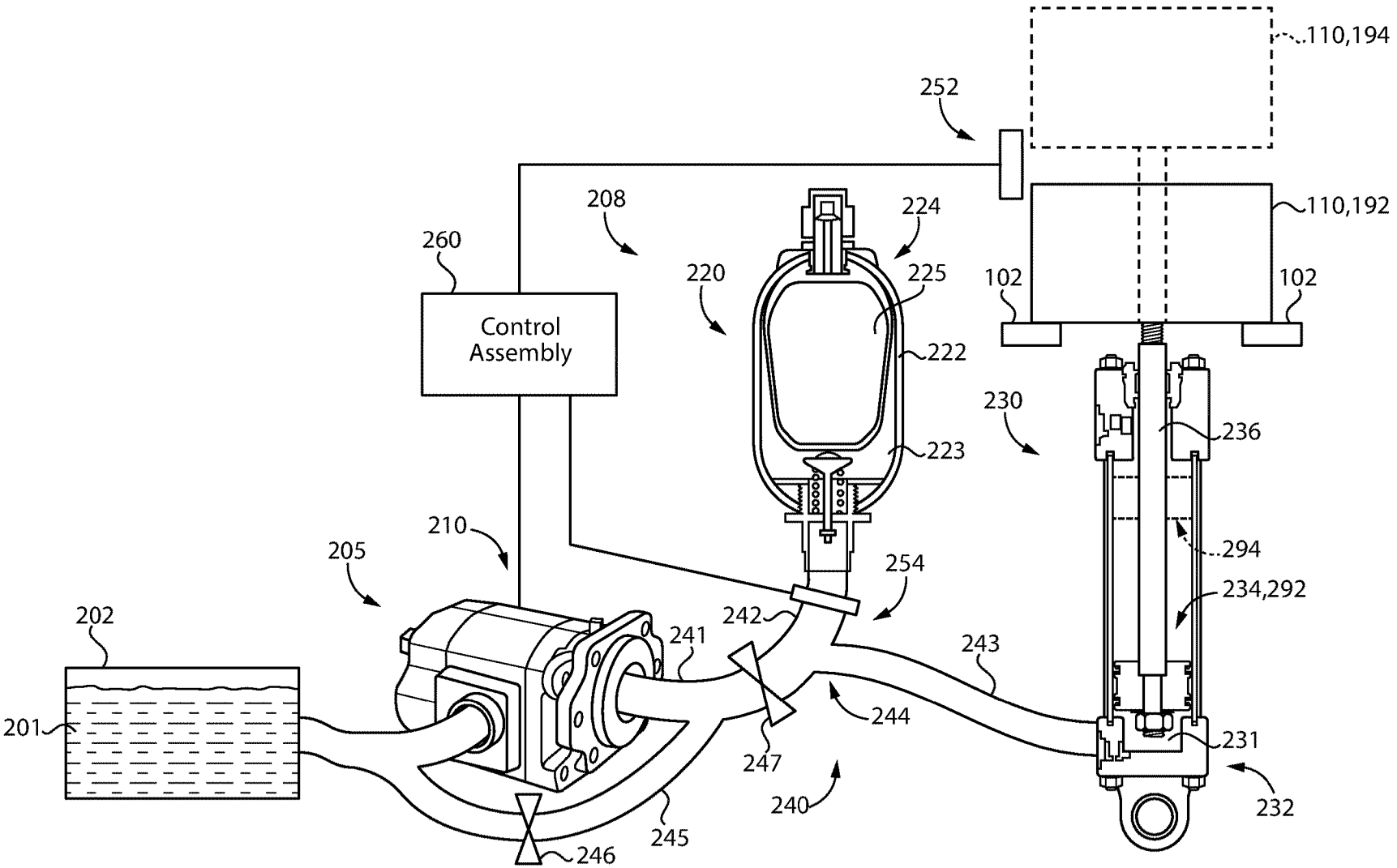
FIG. 2 is a schematic diagram of a hydraulic system according to certain embodiments, which may be utilized in the work machine illustrated in FIG. 1.
Figure 3:
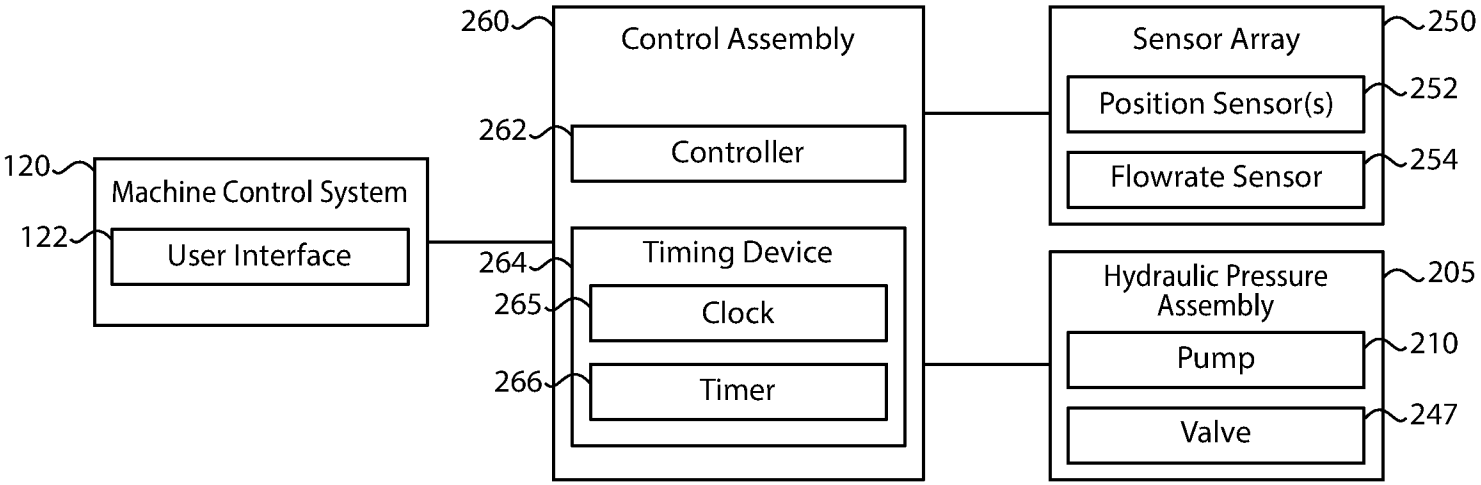
FIG. 3 is a schematic block diagram of a portion of the work machine illustrated in FIG. 1.

With additional reference to FIGS. 2 and 3, the hydraulic system 200 generally includes a hydraulic circuit 208 and a hydraulic pressure assembly 205 operable to charge a hydraulic fluid 201 into and/or out of the hydraulic circuit 208. In the illustrated form, the hydraulic pressure assembly 205 generally includes a pump 210 and/or one or more valves 246, 247 connected between the hydraulic circuit 208 and a pressure source (e.g., the pump 210). The hydraulic circuit 208 generally includes an accumulator 220 operable to receive and discharge hydraulic fluid 201, a hydraulic cylinder 230 connected with the machine component 110, and one or more pressure lines that connect the accumulator 220 and the cylinder 230 with the hydraulic pressure assembly 205. For example, the one or more pressure lines may be provided in a fluid conveyance assembly 240 fluidly connecting the pump 210, the accumulator 220, and the hydraulic cylinder 230. The hydraulic system 200 further includes a sensor array 250 operable to sense one or more operating characteristics of the hydraulic system 200, and a control assembly 260 in communication with the hydraulic pressure assembly 205 and the sensor array 250. In certain embodiments, the control assembly 260 may be in communication with an external device and/or a control system 120 of the work machine 100. Moreover, while the hydraulic system 200 is illustrated as being under control of a control assembly 260 distinct from the control system 120, it is also contemplated that the control assembly 260 may be included in the work machine control system 120.

The pump 210 is operable to pump hydraulic fluid 201 into and/or out of the fluid conveyance assembly 240. For example, the pump 210 may be in fluid communication with a reservoir 202 that contains the hydraulic fluid 201 such that the pump 210 is operable to pump fluid 201 from the reservoir 202 to the fluid conveyance assembly 240 and/or from the fluid conveyance assembly 240 to the reservoir 202. In certain forms, the pump 210 may be submerged in the reservoir 202. The pump 210 may be of any form suitable for pumping hydraulic fluid at relatively high pressures, such as a screw pump, an axial piston pump, a radial piston pump, or other forms of pump.

The accumulator 220 generally includes a shell 222 having a cavity 223 defined therein for receiving hydraulic fluid 201 from the fluid conveyance assembly 240. The accumulator 220 further includes a mechanical energy source 224 operable to store mechanical energy to thereby pressurize the hydraulic fluid 201 within the cavity 223. In the illustrated form, the accumulator 220 is a bladder-based accumulator, in which compressed gas is stored within a bladder 225. It is also contemplated that the accumulator 220 may be provided as another form of accumulator in which the mechanical energy source 224 takes another form, such as that of a weight, a spring, or another source of mechanical energy. Furthermore, while the illustrated accumulator 220 stores compressed gas within the bladder 225 and stores fluid 201 within the cavity 223 but outside the bladder 225, it is also contemplated that this may be reversed such that fluid 201 is stored in the bladder 225 while compressed gas is received within the cavity 223 but outside the bladder 225. Moreover, it should be appreciated that the compressed gas may be separated from the fluid 201 by another form of barrier, such as a piston, or may not necessarily be separated from the fluid 201 by any form of barrier.

The hydraulic cylinder 230 generally includes a body 232 and a piston 234 reciprocably mounted within the body 232 for movement between a first piston position and a second piston position, such as a retracted position 292 and an extended position 294. The piston 234 generally includes a piston head 235 that cooperates with the body 232 to define a fluid-receiving chamber 231, and a piston rod 236 that extends from the piston head 235. The piston rod 236 is operably connected with the machine component 110 such that the first piston position is correlated with the first machine component position and the second piston position is correlated with the second machine component position.

As will be appreciated, charging hydraulic fluid 201 into the chamber 231 drives the piston 234 from its retracted position 292 toward its extended position 294 as the chamber 231 expands, thereby driving the machine component 110 from its lower position 192 toward its upper position 194. Conversely, charging hydraulic fluid 201 out of the chamber 231 drives the piston 234 from its extended position 294 toward its retracted position 292 as the chamber 231 contracts, thereby driving the machine component 110 from its upper position 194 toward its lower position 192.

In the illustrated form, the retracted position 292 of the piston 234 is associated with the lower position 192 of the machine component 110, and the extended position 294 of the piston 234 is correlated with the upper position 194 of the machine component 110. It is also contemplated that the hydraulic cylinder 230 may be connected with the machine component 110 such that the retracted position 292 of the piston 234 is associated with the upper position 194 of the machine component 110 and the extended position 294 of the piston 234 is correlated with the lower position 192 of the machine component 110. Moreover, while the illustrated piston rod 236 is directly coupled with the machine component 110, it is also contemplated that the piston rod 236 may be indirectly coupled with the machine component 110 via one or more intermediate components.

The fluid conveyance assembly 240 includes one or more pressure lines by which the pump 210, the accumulator 220, and the hydraulic cylinder 230 are fluidly connected. In the illustrated form, the one or more pressure lines include a first line 241 connected with the pump 210, a second line 242 connected with the accumulator 220, and a third line 243 connected with the hydraulic cylinder 230. More particularly, the first line 241 is in fluid communication with an outlet of the pump 210, the second line 242 is in fluid communication with the cavity 223 of the accumulator 220, and the third line 243 is in fluid communication with the chamber 231 of the hydraulic cylinder 230. The lines 241, 242, 243 are in fluid communication with one another, and in the illustrated form meet at a junction 244. In the illustrated form, the pump 210 is directly connected with each of the accumulator 220 and the hydraulic cylinder 230 via the lines 241, 242, 243. It is also contemplated that additional components (e.g., one or more valves) may be connected between the pump 210 and the accumulator 220 and/or between the pump 210 and the hydraulic cylinder 230.

In certain embodiments, the fluid conveyance assembly 240 may further include a bypass line 245 that bypasses the pump 210. The bypass line 245 may have an electrically-controllable valve 246 installed thereto such that fluid 201 can selectively flow from hydraulic circuit 208 to the reservoir 202 upon opening of the valve 246. In the illustrated form, an electrically-controllable proportional valve 247 is installed to the first line 241 between the pump 210 and the junction 244. In certain forms, one or both of the valves 246, 247 may be considered to be included in the hydraulic pressure assembly 205.

The sensor array 250 generally includes one or more position sensors 252 by which the position of the machine component 110 can be sensed, and may further include a flowrate sensor 254 operable to sense a flowrate into and/or out of the accumulator 220. One or more of the position sensor(s) 252 is associated with a machine component and may, for example, take the form of a mechanical switch, a magnetic switch, a Hall effect sensor, an inductive sensor, or another form of sensor operable to sense at least one position of the machine component with which the sensor is associated. In certain forms, one or more of the position sensor(s) 252 may take the form of an absolute position sensor, such as a Hall effect sensor, an inductive sensor, or another form of sensor operable to detect the absolute position of the machine component with which the sensor is associated. In certain forms, the machine component with which the position sensor(s) 252 is/are associated may be the piston 234. Additionally or alternatively, the machine component with which the which the position sensor(s) 252 is/are associated may be the machine component 110 that engages the stop(s) 102 and/or one or more intermediate components connected between the piston 234 and the component 110 that engages the stop(s) 102. While other locations are contemplated, in the illustrated form, the flowrate sensor 254 is positioned on the second line 242. It is also contemplated that the flowrate sensor 254 may be omitted.

The control assembly 260 generally includes a controller 262 and a timing device 264, is in communication with each of the hydraulic pressure assembly 205 and the sensor array 250, and may further be in communication with the control system 120. In certain embodiments, the timing device 264 may include at least one of a clock 265 or a timer 266. As described herein, the control assembly 260 is operable to perform a pre-charge determination process to determine the pre-charge of the accumulator 220, and may further be operable to perform a flowrate determination process to determine a flowrate at which hydraulic fluid 201 is charged into or out of the accumulator 220 by the hydraulic pressure assembly 205.

Figure 4:
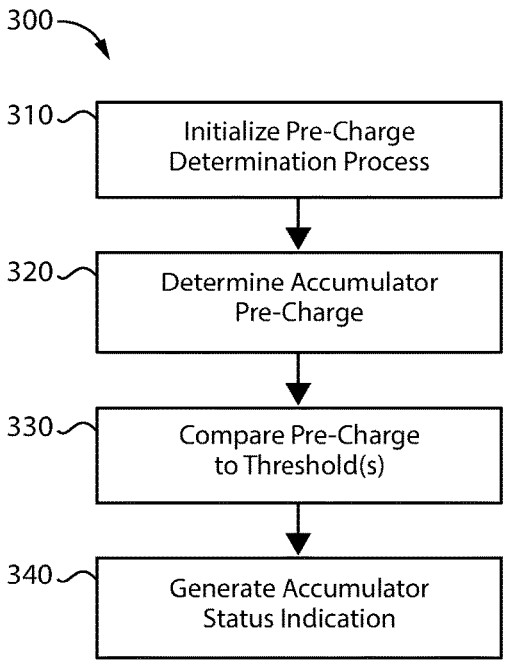
FIG. 4 is a schematic flow diagram of an accumulator status determination process according to certain embodiments.

With additional reference to FIG. 4, an exemplary process 300 that may be performed using the work machine 100 is illustrated. As described herein, the process 300 may be performed to determine a status of the accumulator 220, and may accordingly be referred to as the accumulator status determination process 300. Blocks illustrated for the processes in the present application are understood to be examples only, and blocks may be combined or divided, and added or removed, as well as re-ordered in whole or in part, unless explicitly stated to the contrary. Unless specified to the contrary, it is contemplated that certain blocks performed in the process 300 may be performed wholly by the machine control system 120 or the hydraulic system 200, or that the blocks may be distributed among one or more of the elements and/or additional devices or systems that are not specifically illustrated in FIGS. 1-3. Additionally, while the blocks are illustrated in a relatively serial fashion, it is to be understood that two or more of the blocks may be performed concurrently or in parallel with one another. Moreover, while the process 300 is described herein with specific reference to the work machine 100 and hydraulic system 200 illustrated in FIGS. 1-3, it is to be appreciated that the process 300 may be performed with machines and/or hydraulic systems having additional and/or alternative features.

The process 300 may begin with block 310, which generally involves initializing a pre-charge determination process. Block 310 may, for example, be performed by the control system 120 in response to a user commanding the work machine 100 to determine the status of the accumulator 220, e.g., via a user interface 122. For example, the user may select, via the user interface 122, to run the pre-charge determination process to determine the status of the accumulator 220, and the control system 120 may transmit to the control assembly 260 a pre-charge determination command in response to such selection. As described herein, the process 300 may run to automatically provide the user with an indication of the status of the accumulator 220 without requiring further input from the user.

In response to initialization of the pre-charge determination process in block 310, the process 300 may continue to block 320, which generally includes determining a pre-charge of the accumulator 220. Block 320 may, for example, involve performing the pre-charge determination process 400 illustrated in FIG. 5. It is also contemplated that block 320 may involve determining the pre-charge of the accumulator 220 in another manner.

With block 320 completed, the pre-charge of the accumulator 220 is known, and the process 300 may continue to block 330, which generally involves comparing the pre-charge determined in block 320 to one or more thresholds. In certain embodiments, the one or more thresholds may include multiple thresholds, such as a first threshold and a second threshold. The pre-charge falling below the first threshold may indicate that the accumulator 220 is in need of service, and the pre-charge exceeding the second threshold may indicate that the accumulator 220 is healthy and functioning properly. In certain embodiments, the second threshold may be greater than the first threshold, and the pre-charge falling between the first threshold and the second threshold may indicate that the accumulator 220 is likely to need service or maintenance at some point in the near future.

The process 300 may further include block 340, which generally include generating an accumulator status indication based upon the comparison of block 330. As one example, if the comparison of block 330 indicates that the accumulator 220 is healthy and functioning properly, block 340 may involve generating via the user interface 122 a visual and/or audible indication that the accumulator is not in need of service. As another example, if the comparison of block 330 indicates that the accumulator 220 is in need of service, block 340 may involve generating via the user interface 122 a visual and/or audible indication that the accumulator is in need of service. As a further example, if the comparison of block 330 indicates that the accumulator 220 is likely to need service soon, block 340 may involve generating via the user interface 122 a visual and/or audible indication that the accumulator is likely to need service soon. While block 340 has been described as involving providing the indication via the user interface 122 of the work machine 100, it is also contemplated that block 340 may involve providing the indication via another user interface, such as that of a mobile device in communication with the control system 120 and/or the control assembly 260.

Figure 5:
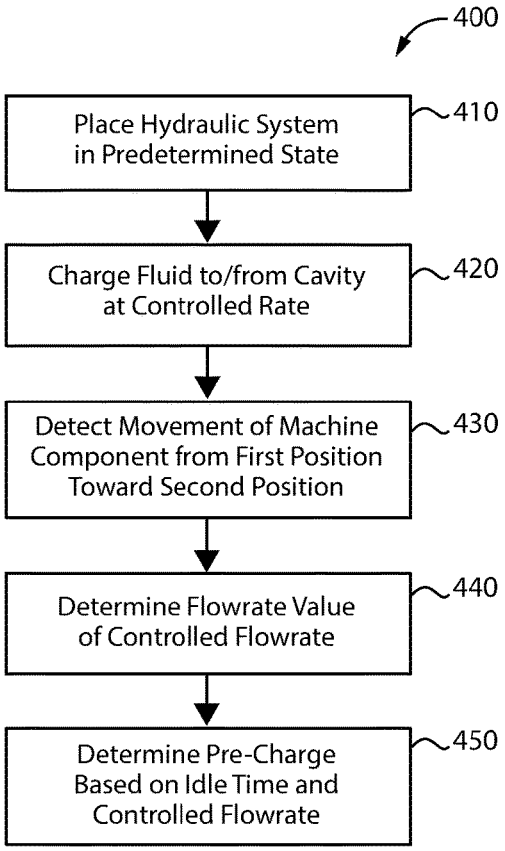
FIG. 5 is a schematic flow diagram of a pre-charge determination process according to certain embodiments.

With additional reference to FIG. 5, an exemplary process 400 that may be performed using the hydraulic system 200 is illustrated. As described herein, the process 400 may be performed to determine the pre-charge in the accumulator 220, and may accordingly be referred to as the pre-charge determination process 400. In certain embodiments, the process 400 may, for example, be utilized in block 320 of the above-described process 300. It is also contemplated that the process 400 may be performed as a standalone process and/or in association with other processes not specifically described herein.

As noted above, blocks illustrated for the processes in the present application are understood to be examples only, and blocks may be combined or divided, and added or removed, as well as re-ordered in whole or in part, unless explicitly stated to the contrary. Additionally, while the blocks are illustrated in a relatively serial fashion, it is to be understood that two or more of the blocks may be performed concurrently or in parallel with one another. Moreover, while the process 400 is described herein with specific reference to the work machine 100 and hydraulic system 200 illustrated in FIGS. 1-3, it is to be appreciated that the process 400 may be performed with machines and/or hydraulic systems having additional and/or alternative features.

The process 400 may begin with block 410, which generally involves placing the hydraulic system 200 in a predetermined state. Block 410 may, for example, involve transmitting from the control assembly 260 to the hydraulic pressure assembly 205 a machine lower command or a machine raise command to which the hydraulic pressure assembly 205 is responsive. In certain embodiments, such as those in which the pre-charge determination process 400 is performed in block 320 of the accumulator status determination process 300, block 410 may be performed in response to the pre-charge determination command transmitted in block 310 of the process 300.

In certain embodiments, the predetermined state may be a low-pressure state, and block 410 may involve transmitting a machine lower command that causes the hydraulic pressure source 205 to charge hydraulic fluid 201 out of the hydraulic circuit 208 to lower the machine component 110 as described herein. In such forms, the hydraulic fluid 201 is discharged from the hydraulic circuit 208 to thereby substantially empty the cavity 223 and the chamber 231 and place the hydraulic circuit 208 in the low-pressure state.

In certain embodiments, the predetermined state may be a high-pressure state, and block 410 may involve transmitting a machine raise command that causes the hydraulic pressure source 205 to charge hydraulic fluid 201 into the hydraulic circuit 208 to raise the machine component 110 as described herein. In such forms, the hydraulic fluid 201 is charged into the hydraulic circuit 208 to thereby substantially fill the cavity 223 and the chamber 231 and place the hydraulic circuit 208 in the high-pressure state.

With the hydraulic system 200 in the predetermined state, the process 400 may continue to block 420, which generally involves charging fluid 201 into or out of the cavity 223 at a controlled flowrate. As described herein, such charging does not initially cause movement of the machine component 110 such that the machine component 110 stays idle for a period of time referred to herein as the idle time. The charging of block 420 eventually causes movement of the machine component 110, which is detected in block 430. The time between the beginning of the charging in block 420 and the detecting of movement in block 430 (i.e., the idle time) may be measured by the controller 262 with the assistance of the timing device 264.

In certain embodiments, the process 400 further includes block 440, which generally involves determining the flowrate value of the controlled flowrate, for example as described below with reference to the processes 500, 600 illustrated in FIGS. 6 and 7. It is also contemplated that block 440 may be omitted, for example in embodiments in which the controlled flowrate has a known or predetermined value and/or in embodiments in which the flowrate has a measured value (e.g., measured by the flowrate sensor 254).

The process 400 further includes block 450, which generally involves determining the pre-charge of the accumulator 220 based upon the idle time and the flowrate value. As described herein, the pre-charge of the accumulator 220 is correlated with the amount of fluid 201 that can be charged into the cavity 223 or discharged from the cavity 223 before the machine component 110 begins to move from its first position toward its second position. Thus, the pre-charge of the accumulator 220 can be determined based upon the idle time and the value of the controlled flowrate, the product of which corresponds to the amount of fluid 201 that is charged into or out of the cavity 223 before movement of the machine component 110 begins. In embodiments in which the process 400 is used in association with block 320 of the process 300, the pre-charge value may be stored in memory and/or transmitted to the control system 120 for processing and evaluation in block 330.

In certain embodiments, the control assembly 260 may have one or more lookup tables stored in memory thereof, and the pre-charge of the accumulator 220 may be determined by looking up the pre-charge value corresponding to the now-known idle time and flowrate value. Alternatively, the lookup tables may correlate pre-charge values with the volume of fluid 201 moved (which is the product of idle time and the flowrate value), and block 450 may involve looking up the pre-charge value corresponding to the now-known volume of fluid 201 moved. The lookup tables may further account for other variables that may affect the correlation of pre-charge with idle time and flowrate value and/or the correlation of pre-charge with volume of fluid 201 moved. For example, the lookup tables may include entries corresponding to different temperatures (e.g., ambient temperature and/or temperature of the hydraulic fluid 201). In such forms, the process 400 may include sensing the appropriate temperature(s) and looking up the pre-charge value corresponding with the sensed temperature(s) and the volume of fluid 201 moved, or looking up the pre-charge value corresponding with the sensed temperature(s), the idle time, and the flowrate value. As will be appreciated, determination of the pre-charge based on look-up tables may involve interpolation and/or extrapolation when the precise values of the independent variables are not accounted for in the lookup tables.

In addition or as an alternative to lookup tables, the control assembly 260 may have one or more equations stored in memory thereof, and the pre-charge of the accumulator 220 may be determined by evaluating the one or more equations using the now-known idle time and flowrate value and/or the calculated volume of fluid 201 moved. Such equations may likewise take account of other variables that may affect the correlation of pre-charge with idle time and flowrate value and/or the correlation of pre-charge with volume of fluid 201 moved, such as temperatures. In such forms, the process 400 may include sensing the appropriate temperature and evaluating the equations using the now-known parameters (e.g., idle time, flowrate value, volume of fluid 201 moved, and/or sensed temperature) to determine the pre-charge based upon the known parameters.

In certain forms, the process 400 may be performed fully automatically (i.e., without further input from the user) in response to receiving the pre-charge determination command from the control system 120. For example, the control assembly 260 may have stored in memory thereof instructions that, when executed by the controller 262, cause the controller 262 to control the hydraulic system 200 to perform the process 400 without further intervention by a user.

As noted above, the illustrated process 400 encompasses multiple embodiments including low-pressure embodiments and high-pressure embodiments. Certain specific implementations of the process 400 will now be described. More particularly, the process 400 will first be described with reference to one or more low-pressure embodiments, and will thereafter be described with reference to one or more high-pressure embodiments.

In one or more of the low-pressure embodiments, the process 400 may begin with block 410, which generally involves placing the hydraulic system 200 in a low-pressure state. Block 410 may, for example, involve transmitting to the hydraulic pressure assembly 205 a machine lower command that causes the hydraulic pressure assembly 205 to discharge fluid 201 from the hydraulic circuit 208. Such discharge of fluid 201 substantially empties the cavity 223 of fluid, and moves the piston 234 to its retracted position. As a result, the machine component 110 adopts its lower position 192, in which the component 110 may rest on the stop(s) 102. Thus, in the low-pressure embodiments, the first position of the machine component 110 may be the lower position 192.

With the hydraulic system 200 in the low-pressure state, the low-pressure embodiment of the process 400 may proceed to block 420, which generally involves charging hydraulic fluid 201 into the cavity 223 at a controlled rate. For example, block 420 may involve the control assembly 260 operating the hydraulic pressure assembly 205 to charge the hydraulic fluid 201 into the hydraulic circuit 208 at a relatively constant rate. In certain embodiments, the controlled rate may be controlled by one or more proportional valves, such as the valve 247. For example, block 420 may involve cracking the valve 247 to permit a pressure source (e.g., the pump 210) to charge fluid 201 into the hydraulic circuit 208. Such charging of hydraulic fluid 201 into the hydraulic circuit 208 initially begins to fill the cavity 223, which is at a lower pressure than the chamber 231. Upon beginning to charge the fluid 201 into the hydraulic circuit 208, the controller 262 begins to measure the idle time using the timing device 264. For example, in embodiments in which the timing device 264 includes a clock 265, the controller 262 may take note of the time at which the charging of block 420 begins. As another example, in embodiments in which the timing device 264 includes a timer 266, the controller 262 may initiate the timer 266.

As the fluid 201 flows into the accumulator cavity 223, the accumulator cavity 223 begins to fill, eventually compressing the bladder 225 to raise the pressure in the hydraulic circuit 208. The piston 234 will not start to move until the pressure in the hydraulic circuit 208 is equal to the pressure on the piston 234 that would keep the piston 234 from moving from the first or retracted position 292. At that point, the pressure of the accumulator 220 will start to cause the piston 234 to move toward its second or extended position 294, which movement is detected in block 430.

Upon detection of the movement in block 430, the controller 262 stops the idle time measurement and determines the idle time. For example, in embodiments in which the timing device 264 includes a clock 265, the controller 262 may take note of the time at which the detecting of block 430 occurs, and subtract from this value the time at which the charging of block 420 began in order to determine the idle time. As another example, in embodiments in which the timing device 264 includes a timer 266, the controller 262 may stop the timer 266 such that the value of the timer 266 corresponds to the idle time.

As noted above, the process 400 may include block 440, which generally involves determining the flowrate value of the controlled flowrate. Further details regarding example processes for determining the flowrate value are provided below with reference to the processes 500, 600 illustrated in FIGS. 6 and 7. It is also contemplated that block 440 may be omitted, for example in embodiments in which the controlled flowrate has a known or predetermined value and/or in embodiments in which the flowrate has a measured value (e.g., measured by the flowrate sensor 254).

The process 400 further includes block 450, which generally involves determining the pre-charge based upon the idle time and the flowrate value of the controlled flowrate. As noted above, such determination may be performed by the control assembly 260 using one or more lookup tables and/or one or more equations. With the pre-charge determined in block 450, the pre-charge value may be transmitted to the control system 120 and/or stored in memory of the control assembly 260, and the process 400 may terminate.

In one or more of the high-pressure embodiments, the process 400 may begin with block 410, which generally involves placing the hydraulic system 200 in a high-pressure state. Block 410 may, for example, involve transmitting to the hydraulic pressure assembly 205 a machine raise command that causes the hydraulic pressure assembly 205 to charge fluid 201 into the hydraulic circuit 208. Such charging of fluid 201 into the hydraulic circuit 208 fills the cavity 223 and compresses the bladder 225, and expands the chamber 231 and places the piston 234 in its extended position 294. As a result, the machine component 110 adopts its upper position 194. Thus, in the high-pressure embodiments, the first position of the machine component 110 may be the upper position 194.

In one or more of the high-pressure embodiments, block 420 involves charging hydraulic fluid 201 out of the hydraulic circuit 208 at a controlled rate. For example, block 420 may involve the control assembly 260 operating the valves 246, 247 to thereby permit fluid 201 to flow from the hydraulic circuit 208 to the reservoir 202 at a controlled rate. Upon beginning to discharge the fluid 201 from the hydraulic circuit 208, the controller 262 begins to measure the idle time using the timing device 264. For example, in embodiments in which the timing device 264 includes a clock 265, the controller 262 may take note of the time at which the discharging of block 420 begins. As another example, in embodiments in which the timing device 264 includes a timer 266, the controller 262 may initiate the timer 266.

As the fluid 201 is discharged from the hydraulic circuit 208, fluid 201 initially begins to flow out of the accumulator cavity 223. As fluid 201 flows out of the accumulator cavity 223, the accumulator cavity 223 begins to empty, thereby permitting expansion of the bladder 225 as pressure in the accumulator 220 reduces. This reduction in accumulator pressure causes a corresponding decrease in pressure in the hydraulic circuit 208, but the piston 234 will not start to move until the pressure in the circuit 208 falls to an equilibrium with the pressure urging the piston 234 toward the second piston position (i.e., the retracted position 292). When the pressure urging the piston 234 toward its retracted second position 292 exceeds the pressure in the hydraulic circuit 208, the piston 234 begins to move from its extended first position 294, thereby causing the machine component 110 to begin to lower from its upper position 194 toward its lower position 192.

In block 430, movement of the machine component is detected by the control assembly 260 via the position sensor(s) 252. Upon detection of the movement in block 430, the controller 262 stops the idle time measurement and determines the idle time. For example, in embodiments in which the timing device 264 includes a clock 265, the controller 262 may take note of the time at which the detecting of block 430 occurs, and subtract from this value the time at which the charging of block 420 began in order to determine the idle time. As another example, in embodiments in which the timing device 264 includes a timer 266, the controller 262 may stop the timer 266 such that the value of the timer 266 corresponds to the idle time.

As noted above, the process 400 may include block 440, which generally involves determining the flowrate value of the controlled flowrate. Further details regarding example processes for determining the flowrate value are provided below with reference to the processes 500, 600 illustrated in FIGS. 6 and 7. It is also contemplated that block 440 may be omitted, for example in embodiments in which the controlled flowrate has a known or predetermined value and/or in embodiments in which the flowrate has a measured value (e.g., measured by the flowrate sensor 254).

The process 400 further includes block 450, which generally involves determining the pre-charge based upon the idle time and the flowrate value of the controlled flowrate. As noted above, such determination may be performed by the control assembly 260, for example using one or more lookup tables and/or one or more equations. With the pre-charge determined in block 450, the pre-charge value may be transmitted to the control system 120 and/or stored in memory, and the process 400 may terminate.

Figure 6:
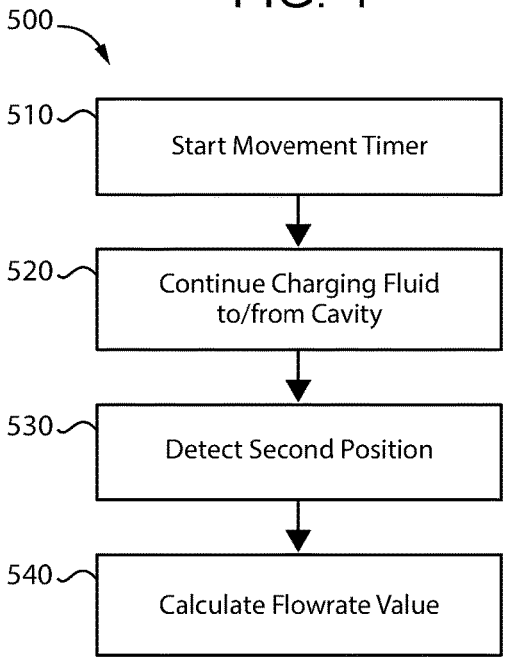
FIG. 6 is a schematic flow diagram of a flowrate determination process according to certain embodiments.

With additional reference to FIG. 6, illustrated therein is a process 500 that may be performed using the hydraulic system 200. As described herein, the process 500 may be performed to determine the flowrate value of the controlled flowrate, and may accordingly be referred to as a flowrate determination process 500. In certain embodiments, the process 500 may, for example, be utilized in block 440 of the above-described pre-charge determination process 400. It is also contemplated that the process 500 may be performed as a standalone process and/or in combination with other processes not specifically described herein.

As noted above, blocks illustrated for the processes in the present application are understood to be examples only, and blocks may be combined or divided, and added or removed, as well as re-ordered in whole or in part, unless explicitly stated to the contrary. Additionally, while the blocks are illustrated in a relatively serial fashion, it is to be understood that two or more of the blocks may be performed concurrently or in parallel with one another. Moreover, while the process 500 is described herein with specific reference to the work machine 100 and hydraulic system 200 illustrated in FIGS. 1-3, it is to be appreciated that the process 500 may be performed with machines and/or hydraulic systems having additional and/or alternative features.

The process 500 may begin in response to detection of movement of the machine component 110 from its first position (e.g. one of the lower position 192 or the upper position 194) toward its second position (e.g., the other of the lower position 192 or the upper position 194), for example as described above with reference to block 430. In response to detection of such movement, the controller 262 may initiate block 510, which involves starting a movement timer using the timing device 264. For example, in embodiments in which the timing device 264 includes a clock 265, the controller 262 may take note of the time at which the movement is detected. As another example, in embodiments in which the timing device 264 includes a timer 266, the controller 262 may initiate the timer 266.

The process 500 further includes block 520, which generally involves continuing to charge hydraulic fluid 201 into or out of the hydraulic circuit 208 at the controlled rate, for example by controlling the hydraulic pressure assembly 205 to continue to provide the controlled rate of charging/discharging. For example, block 520 may involve charging fluid 201 into the hydraulic circuit 208 in low-pressure embodiments, and may involve charging fluid 201 out of the hydraulic circuit 208 in high-pressure embodiments. Such charging causes the piston 234 to continue its movement from the first piston position (e.g. one of the retracted position 292 or the extended position 294) toward the second piston position (e.g., the other of the retracted position 292 or the extended position 294), thereby causing a corresponding movement of the machine component 110 from the first machine component position (e.g., one of the lower position 192 or the upper position 194) toward the second machine component position (e.g., the other of the lower position 192 or the upper position 194).

The charging of block 520 may continue until the machine component 110 is detected in in the second machine component position by the position sensor(s) 252 in block 530, at which point the charging of block 520 may terminate and the movement timer may be stopped. In embodiments in which the timing device 264 includes a clock 265, stopping the movement timer may involve noting the time on the clock 265, and subtracting from that time the time noted in block 510. In embodiments in which the timing device 264 includes a timer 266, stopping the movement timer may involve stopping the timer 266. The movement time thus corresponds to the time to move the machine component 110 from its predetermined first position to its predetermined second position, which corresponds with a known change of volume in the chamber 231. More particularly, the chamber 231 has a first volume when the machine component 110 is in its first position, and has a second volume when the machine component 110 is in its second position. A volume change is defined as the difference between the first volume and the second volume, and a value of the volume change may be stored in memory of the control assembly 260.

With the movement time now known, the process 500 may continue to block 540, which generally involves calculating the controlled flowrate value based in part upon the movement time. The calculating of block 540 may further be based upon a known volume change of the hydraulic cylinder 230, the volume change corresponding to the difference in the volume of the chamber 231 when the piston 234 is in its extended position 294 and the volume of the chamber 231 when the piston is in its retracted position 292. As will be appreciated, this volume change corresponds to the volume of fluid 201 that was charged into or out of the chamber 231 during movement of the piston 234 from the first piston position to the second piston position. Block 540 may, for example, involve dividing the volume change by the movement time to obtain a volumetric flowrate value. The flowrate value calculated in block 540 may be noted in memory by the controller 262, for example to be used in the pre-charge determination of block 450.

As will be appreciated, the process 500 may be performed automatically, for example by the controller 262 executing stored instructions to cause the various components of the hydraulic system 200 to perform the functions required to execute the process 500.

Figure 7:
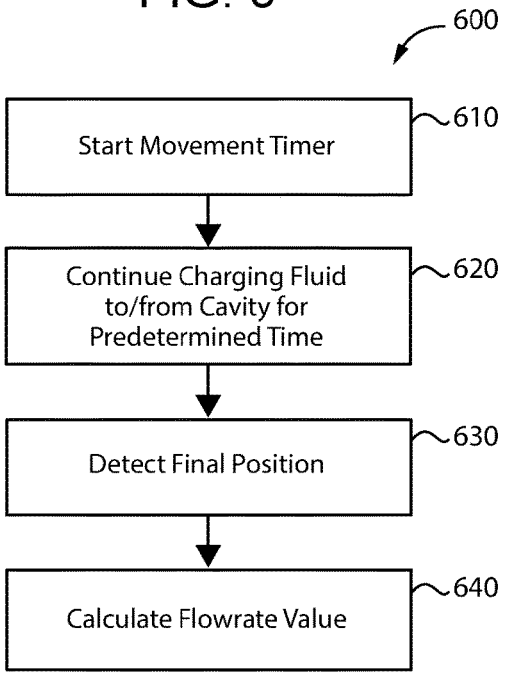
FIG. 7 is a schematic flow diagram of a flowrate determination process according to certain embodiments.

With additional reference to FIG. 7, illustrated therein is a process 600 that may be performed using the hydraulic system 200. As described herein, the process 600 may be performed to determine the flowrate value of the controlled flowrate, and may accordingly be referred to as a flowrate determination process 600. In certain embodiments, the process 600 may, for example, be utilized in block 440 of the above-described process 400. It is also contemplated that the process 600 may be performed as a standalone process and/or in connection with other processes not specifically described herein.

As noted above, blocks illustrated for the processes in the present application are understood to be examples only, and blocks may be combined or divided, and added or removed, as well as re-ordered in whole or in part, unless explicitly stated to the contrary. Additionally, while the blocks are illustrated in a relatively serial fashion, it is to be understood that two or more of the blocks may be performed concurrently or in parallel with one another. Moreover, while the process 600 is described herein with specific reference to the work machine 100 and hydraulic system 200 illustrated in FIGS. 1-3, it is to be appreciated that the process 600 may be performed with machines and/or hydraulic systems having additional and/or alternative features.

The process 600 may begin in response to detection of movement of the machine component 110 from its first position (e.g. one of the lower position 192 or the upper position 194) toward its second position (e.g., the other of the lower position 192 or the upper position 194), for example as described above with reference to block 430 of the pre-charge determination process 400. In response to detection of such movement, the controller 262 may perform block 610, which involves starting a movement timer using the timing device 264. For example, in embodiments in which the timing device 264 includes a clock 265, the controller 262 may take note of the time at which the movement of the machine component 110 is detected. As another example, in embodiments in which the timing device 264 includes a timer 266, the controller 262 may initiate the timer 266.

The process 600 further includes block 620, which generally involves continuing to charge fluid into or out of the hydraulic circuit 208 at the controlled rate, for example by operating the hydraulic pressure assembly 205 to continue charging the fluid 201 into or out of the hydraulic circuit 208 at the same controlled rate that was utilized in block 420 of the process 400. For example, block 620 may involve charging fluid 201 into the hydraulic circuit 208 in low-pressure embodiments, and may involve charging fluid 201 out of the hydraulic circuit 208 in high-pressure embodiments. Such charging causes the piston 234 to move from the first piston position (e.g. one of the retracted position 292 or the extended position 294) toward the second piston position (e.g., the other of the retracted position 292 or the extended position 294), thereby causing a corresponding movement of the machine component 110 from the first machine component position (e.g., one of the lower position 192 or the upper position 194) toward the second machine component position (e.g., the other of the lower position 192 or the upper position 194). The charging of block 620 may continue until a predetermined movement time has elapsed on the movement timer, at which point the charging of block 620 may end.

Once the predetermined movement time has elapsed and the charging of block 620 has terminated, the process 600 may continue to block 630, which generally involves sensing the final position of the machine component 110. The final position may be a position between the lower position 192 and the upper position 194, and block 630 may involve detecting this final position using the position sensor(s) 252. Based upon the difference in the first position and the final positon, the controller 262 may calculate the volume change of the chamber 231 (i.e., the difference in the volume of the chamber 231 when the piston 234 is in its first position and the volume of the chamber 231 when the piston 234 is in a final position corresponding to the final position of the machine component 110). Such calculation may, for example, involve the use of one or more lookup tables and/or one or more equations.

With the volume change now known, the process 600 may continue to block 640, which generally involves calculating the controlled flowrate value based upon the now-known volume change and the predetermined movement time. For example, block 640 may involve dividing the calculated or determined volume change by the predetermined movement time to obtain a volumetric flowrate value. The flowrate value calculated in block 640 may be noted in memory by the controller 262, for example to be used in the pre-charge determination of block 450.

As will be appreciated, the process 600 may be performed automatically, for example by the controller 262 executing stored instructions to cause the various components of the hydraulic system 200 to perform the functions required to execute the process 600.

As should be evident from the foregoing, the processes 300, 400, 500, 600 described herein may be used in various combinations to determine one or more of a flowrate value, a pre-charge value, and/or an accumulator status indication. As one example, the flowrate determination process 500 may be utilized to determine a controlled flowrate value based upon a known or predetermined volume change and a measured movement time. As another example, the flowrate determination process 600 may be utilized to determine a controlled flowrate value based upon a known or predetermined movement time and a measured volume change. In certain embodiments, this determined flowrate value may be utilized in the pre-charge determination process 400 to determine a pre-charge value based upon the determined flowrate value and a measured idle time. Alternatively, the pre-charge determination process 400 may be performed to determine the pre-charge value based upon the measured idle time and a predetermined flowrate value or a measured flowrate value.

In certain embodiments, the pre-charge determined in the pre-charge determination process 400 may be utilized in the process 300 to generate an accumulator status indication. It is also contemplated that the pre-charge value utilized in the process 300 may be determined according to other processes. For example, a process according to certain embodiments may involve sensing the volume of fluid 201 moved between the beginning of charging and the detection of movement using a volumetric flow sensor, and the volume of fluid 201 moved may be used to look up and/or calculate the pre-charge in a manner analogous to that described in connection with block 450 without requiring the sensing of idle time and/or the determination of the flowrate value.

Certain conventional approaches to determining a pre-charge of an accumulator require that a pressure sensor be disposed at some location within the hydraulic circuit. It has been found that such pressure sensors can complicate the system and/or present other undesirable difficulties. As should be evident from the foregoing, however, certain embodiments of the processes described herein involve determining the pre-charge of the accumulator 220 without requiring the use of a pressure sensor, thereby obviating the difficulties that may be associated with providing such a pressure sensor.

Figure 8:
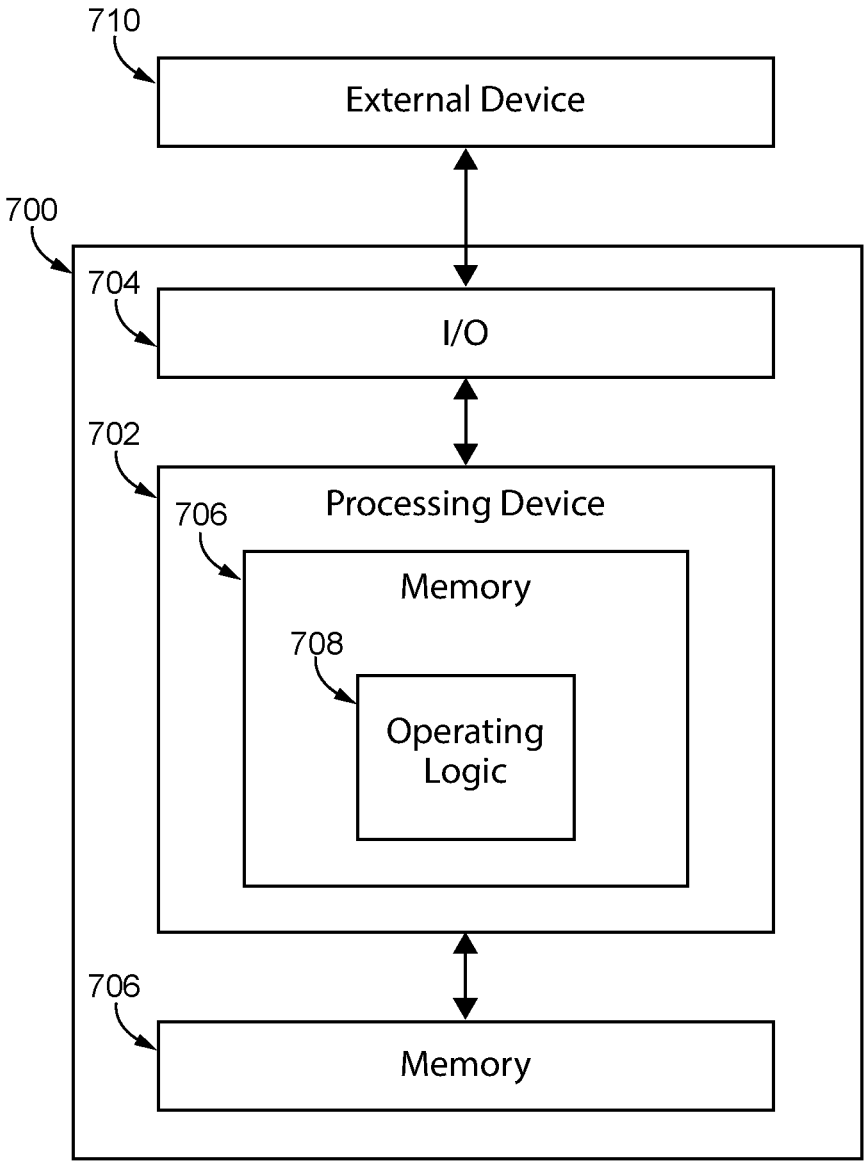
FIG. 8 is a schematic block diagram of a computing device that may be utilized in certain embodiments.

Referring now to FIG. 8, a simplified block diagram of at least one embodiment of a computing device 700 is shown. The illustrative computing device 700 depicts at least one embodiment of a control system or controller that may be utilized in connection with the control system 120 and/or controller 262 illustrated in FIG. 3.

Depending on the particular embodiment, the computing device 700 may be embodied as a server, desktop computer, laptop computer, tablet computer, notebook, netbook, Ultrabook™ mobile computing device, cellular phone, smartphone, wearable computing device, personal digital assistant, Internet of Things (IoT) device, control panel, processing system, router, gateway, and/or any other computing, processing, and/or communication device capable of performing the functions described herein.

The computing device 700 includes a processing device 702 that executes algorithms and/or processes data in accordance with operating logic 708, an input/output device 704 that enables communication between the computing device 700 and one or more external devices 710, and memory 706 which stores, for example, data received from the external device 710 via the input/output device 704.

The input/output device 704 allows the computing device 700 to communicate with the external device 710. For example, the input/output device 704 may include a transceiver, a network adapter, a network card, an interface, one or more communication ports (e.g., a USB port, serial port, parallel port, an analog port, a digital port, VGA, DVI, HDMI, FireWire, CAT 5, or any other type of communication port or interface), and/or other communication circuitry. Communication circuitry may be configured to use any one or more communication technologies (e.g., wireless or wired communications) and associated protocols (e.g., Ethernet, Bluetooth®, Bluetooth Low Energy (BLE), WiMAX, etc.) to effect such communication depending on the particular computing device 700. The input/output device 704 may include hardware, software, and/or firmware suitable for performing the techniques described herein.

The external device 710 may be any type of device that allows data to be inputted or outputted from the computing device 700. For example, in various embodiments, the external device 710 may be embodied as the control system 120, the control assembly 260, the pump 210, the valve 246, the valve 247, and/or the sensor array 250. Further, in some embodiments, the external device 710 may be embodied as another computing device, switch, diagnostic tool, controller, printer, display, alarm, peripheral device (e.g., keyboard, mouse, touch screen display, etc.), and/or any other computing, processing, and/or communication device capable of performing the functions described herein. Furthermore, in some embodiments, it should be appreciated that the external device 710 may be integrated into the computing device 700.

The processing device 702 may be embodied as any type of processor(s) capable of performing the functions described herein. In particular, the processing device 702 may be embodied as one or more single or multi-core processors, microcontrollers, or other processor or processing/controlling circuits. For example, in some embodiments, the processing device 702 may include or be embodied as an arithmetic logic unit (ALU), central processing unit (CPU), digital signal processor (DSP), and/or another suitable processor(s). The processing device 702 may be a programmable type, a dedicated hardwired state machine, or a combination thereof. Processing devices 702 with multiple processing units may utilize distributed, pipelined, and/or parallel processing in various embodiments. Further, the processing device 702 may be dedicated to performance of just the operations described herein, or may be utilized in one or more additional applications. In the illustrative embodiment, the processing device 702 is of a programmable variety that executes algorithms and/or processes data in accordance with operating logic 708 as defined by programming instructions (such as software or firmware) stored in memory 706. Additionally or alternatively, the operating logic 708 for processing device 702 may be at least partially defined by hardwired logic or other hardware. Further, the processing device 702 may include one or more components of any type suitable to process the signals received from input/output device 704 or from other components or devices and to provide desired output signals. Such components may include digital circuitry, analog circuitry, or a combination thereof.

The memory 706 may be of one or more types of non-transitory computer-readable media, such as a solid-state memory, electromagnetic memory, optical memory, or a combination thereof. Furthermore, the memory 706 may be volatile and/or nonvolatile and, in some embodiments, some or all of the memory 706 may be of a portable variety, such as a disk, tape, memory stick, cartridge, and/or other suitable portable memory. In operation, the memory 706 may store various data and software used during operation of the computing device 700 such as operating systems, applications, programs, libraries, and drivers. It should be appreciated that the memory 706 may store data that is manipulated by the operating logic 708 of processing device 702, such as, for example, data representative of signals received from and/or sent to the input/output device 704 in addition to or in lieu of storing programming instructions defining operating logic 708. As illustrated, the memory 706 may be included with the processing device 702 and/or coupled to the processing device 702 depending on the particular embodiment. For example, in some embodiments, the processing device 702, the memory 706, and/or other components of the computing device 700 may form a portion of a system-on-a-chip (SoC) and be incorporated on a single integrated circuit chip.

In some embodiments, various components of the computing device 700 (e.g., the processing device 702 and the memory 706) may be communicatively coupled via an input/output subsystem, which may be embodied as circuitry and/or components to facilitate input/output operations with the processing device 702, the memory 706, and other components of the computing device 700. For example, the input/output subsystem may be embodied as, or otherwise include, memory controller hubs, input/output control hubs, firmware devices, communication links (i.e., point-to-point links, bus links, wires, cables, light guides, printed circuit board traces, etc.) and/or other components and subsystems to facilitate the input/output operations.

The computing device 700 may include other or additional components, such as those commonly found in a typical computing device (e.g., various input/output devices and/or other components), in other embodiments. It should be further appreciated that one or more of the components of the computing device 700 described herein may be distributed across multiple computing devices. In other words, the techniques described herein may be employed by a computing system that includes one or more computing devices. Additionally, although only a single processing device 702, I/O device 704, and memory 706 are illustratively shown in FIG. 8, it should be appreciated that a particular computing device 700 may include multiple processing devices 702, I/O devices 704, and/or memories 706 in other embodiments. Further, in some embodiments, more than one external device 710 may be in communication with the computing device 700.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected.

It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A method, comprising:

charging hydraulic fluid into or out of a cavity of an accumulator at a controlled flowrate;

detecting movement of a machine component from a first position toward a second position, wherein the movement of the machine component from the first position toward the second position is a result of the charging of hydraulic fluid into or out of the cavity;

determining an idle time spanning from a start of the charging to detection of the movement of the machine component; and determining a pre-charge of the accumulator based upon the idle time and a flowrate value of the controlled flowrate.

2. The method of claim 1, further comprising generating an accumulator status signal based upon the pre-charge.

3. The method of claim 2, further comprising comparing the pre-charge of the accumulator to one or more thresholds;

wherein the accumulator status signal is generated based upon the comparing.

4. The method of claim 1, further comprising monitoring the charging to thereby sense the flowrate value.

5. The method of claim 1, wherein the controlled flowrate is a predetermined flowrate such that the flowrate value is a known flowrate value.

6. The method of claim 1, wherein the machine component is operably coupled with a piston of a hydraulic cylinder comprising a chamber that expands and contracts with movement of the piston;

wherein the chamber has a first volume when the machine component is in the first position; and wherein the chamber has a second volume when the machine component is in the second position.

7. The method of claim 6, further comprising determining the flowrate value, wherein determining the flowrate value comprises:

detecting the machine component at the second position;

measuring a movement time spanning from detection of movement of the machine component from the first position to detection of the machine component at the second position; and calculating the flowrate value based upon the movement time and a difference between the first volume and the second volume.

8. The method of claim 6, further comprising determining the flowrate value, wherein determining the flowrate value comprises:

continuing to charge the hydraulic fluid into or out of the cavity at the controlled flowrate for a predetermined movement time, thereby moving the machine component to a third position intermediate the first position and the second position;

detecting the machine component at the third position;

determining a third volume of the chamber based upon the detected third position; and calculating the flowrate value based upon the predetermined movement time and a difference between the first volume and the third volume.

9. The method of claim 6, wherein the first position is an upper position and the second position is a lower position; and wherein the first volume is greater than the second volume.

10. The method of claim 1, wherein the pre-charge is determined without requiring a pressure measurement.

11. A hydraulic system, comprising:

a hydraulic circuit comprising:

an accumulator comprising a cavity, the accumulator having a pre-charge;

a hydraulic cylinder comprising a chamber and a piston that partially defines the chamber, wherein the piston is mounted for reciprocal movement between a first piston position and a second piston position to expand and contract the chamber; and one or more pressure lines through which the cavity is in fluid communication with the chamber;

a hydraulic pressure assembly operable to charge hydraulic fluid into and/or out of hydraulic circuit at a controlled flowrate;

a sensor array comprising at least one position sensor operable to detect at least one position of the piston;

a control assembly in communication with the hydraulic pressure assembly and the sensor array, wherein the control assembly is configured to:

control the hydraulic pressure assembly to charge hydraulic fluid into or out the cavity at the controlled flowrate;

detect, via the sensor array, movement of the piston from the first piston position toward the second piston position as a result of the charging of hydraulic fluid into or out of the cavity;

determine an idle time spanning from a start of the charging to detection of the movement of the piston; and determine the pre-charge of the accumulator based upon the idle time and a flowrate value of the controlled flowrate.

12. The hydraulic system of claim 11, wherein the hydraulic pressure assembly comprises a pump.

13. The hydraulic system of claim 12, wherein the at least one pressure line comprises a first pressure line in fluid communication with the pump, a second pressure line in fluid communication with the cavity, and a third pressure line in fluid communication with the chamber, wherein the first pressure line meets the second pressure line and the third pressure line at a junction; and wherein the hydraulic pressure assembly further comprises an electrically-controllable valve operable to open and close the first pressure line, the valve positioned between the pump and the junction.

14. The hydraulic system of claim 11, wherein the hydraulic pressure assembly comprises an electrically-controllable valve connected between the hydraulic pressure assembly and the hydraulic circuit.

15. The hydraulic system of claim 11, wherein the chamber has a first volume when the piston is in the first piston position;

wherein the chamber has a second volume when the piston is in the second piston position; and wherein the control assembly is further configured to:

detect, via the sensor array, the piston at the second piston position;

measure a movement time spanning from detection of movement of the piston from the first piston position to detection of the piston at the second piston position; and calculate the flowrate value based upon the movement time and a difference between the first volume and the second volume.

16. The hydraulic system of claim 11, wherein the chamber has a first volume when the piston is in the first piston position; and wherein the control assembly is further configured to:

control the hydraulic pressure assembly to continue charging the hydraulic fluid into or out of the cavity at the controlled flowrate for a predetermined movement time, thereby moving the piston from the first piston position to a third piston position intermediate the first piston position and the second piston position;

detect, via the sensor array, the piston at the third piston position;

determine a third volume of the chamber based upon the detected third piston position; and calculate the flowrate value based upon the predetermined movement time and a difference between the first volume and the third volume.

17. A work machine comprising the hydraulic system of claim 11, the work machine further comprising:

a machine component operably coupled with the piston such that the machine component movement of the machine component between an upper position and a lower position is correlated with reciprocal movement of the piston between the first piston position and the second piston position.

18. The work machine of claim 17, wherein the at least one position sensor is operable to detect the at least one position of the piston by detecting at least one position of the machine component.

19. The work machine of claim 17, further comprising a safety stop against which the machine component rests when the machine component is in the lower position.

20. The work machine of claim 17, further comprising a control system including a user interface, wherein the control system is configured to compare the pre-charge of the accumulator to one or more thresholds, and to generate, via the user interface, an accumulator status signal based upon the comparing.

* * * * *